US006101713A

United States Patent [19]

May et al.

[11] Patent Number: 6,101,713

[45] Date of Patent: Aug. 15, 2000

[54] METHOD OF CALIBRATING A PRE-FORMED RECESS

[75] Inventors: Ewald May, Bonn; Antonio Casellas, Siegburg, both of Germany

[73] Assignee: Krebsöge Sinterholding GmbH, Radevormwald, Germany

[21] Appl. No.: 08/921,112

[22] Filed: Aug. 29, 1997

[30] Foreign Application Priority Data

Aug. 30, 1996 [DE] Germany ..... 196 35 183

[51] Int. Cl.[7] ..... B23P 9/00

[52] U.S. Cl. ..... 29/888.042; 29/888.049; 29/445; 29/525

[58] Field of Search ..... 29/407.01, 407.05, 29/445, 525, 888.04, 888.042, 888.044, 888.049; 72/401, 398, 471

[56] References Cited

U.S. PATENT DOCUMENTS

| | | | |
|---|---|---|---|
| 6,683 | 8/1849 | Cox | 72/401 |
| 2,089,790 | 8/1937 | Halpern | 29/407.05 |
| 2,294,095 | 8/1942 | Pease | 29/525 |
| 2,388,953 | 11/1945 | Coombs | 72/398 X |
| 2,446,621 | 8/1948 | Thiry | 29/407.05 |
| 2,501,826 | 3/1950 | McCarthy et al. | 29/525 X |
| 2,610,686 | 9/1952 | Krasberg | 29/407.01 X |
| 2,627,120 | 2/1953 | Hotchkiss | 29/407.01 X |
| 3,209,437 | 10/1965 | Voorhies | 29/407.01 X |
| 3,255,521 | 6/1966 | Callahan, Jr. | 29/407.05 |
| 3,267,570 | 8/1966 | Winkler | 29/407.05 X |
| 3,492,715 | 2/1970 | Maton | 29/407.05 |
| 3,834,212 | 9/1974 | Roper | 72/401 X |
| 4,088,001 | 5/1978 | Ishikawa et al. | 72/401 X |

*Primary Examiner*—Joseph M. Gorski
*Attorney, Agent, or Firm*—Venable; Gabor J. Kelemen; Leo J. Jennings

[57] ABSTRACT

A method of calibrating a component having first and second opposite large surfaces and a peripheral surface which interconnects the large surfaces and which is provided with a recess, includes the steps of placing the component in a calibrating die, thereafter introducing a calibrating slide into the recess, contacting the first large surface by a first die punch and contacting the second large surface by a second die punch for positively positioning the component in the calibrating die by the calibrating slide and the first and second die punches, and then applying a calibrating pressure to the opposite large surfaces of the component by the die punches for deforming the component to effect calibration of the recess to desired dimensions as determined by a thickness of the calibrating slide situated in the recess.

4 Claims, 4 Drawing Sheets

FIG. 4.1
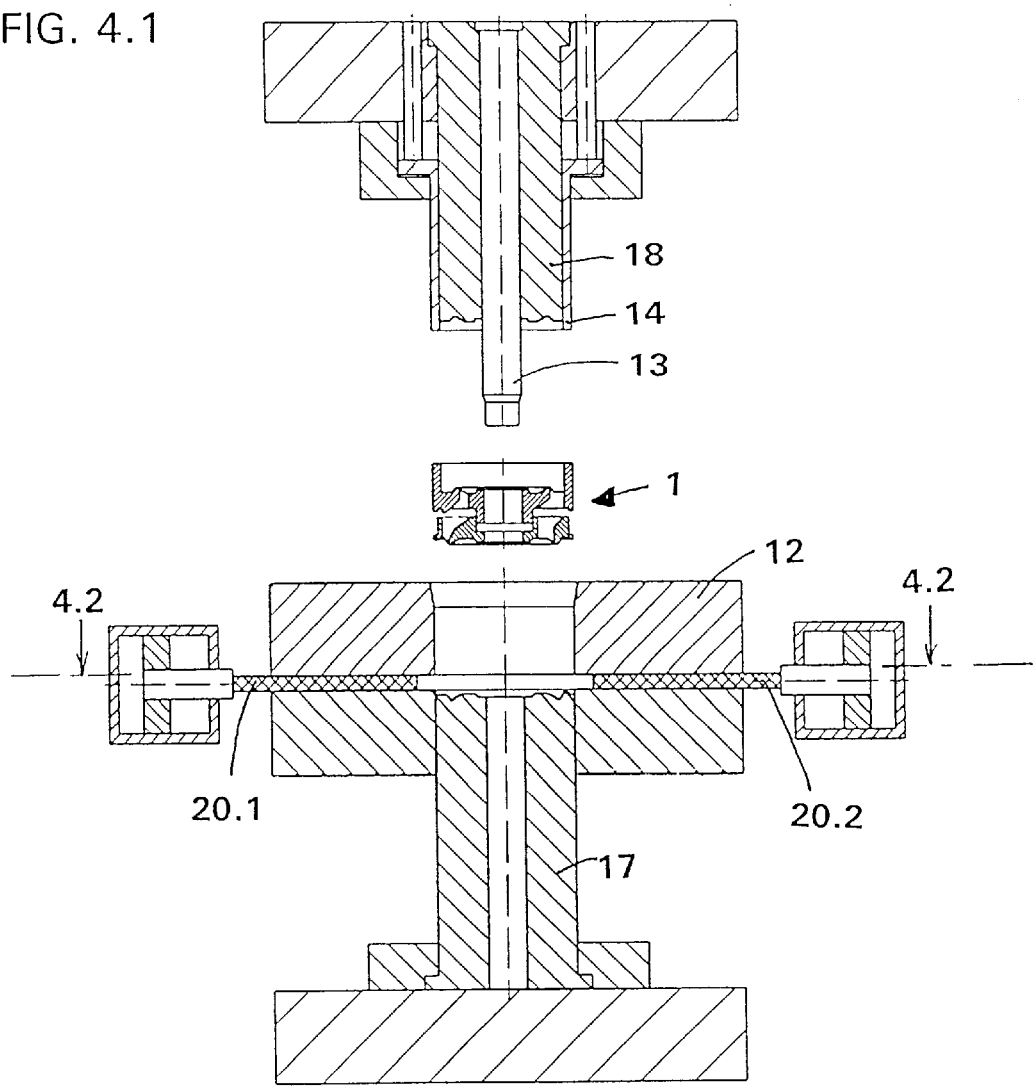
FIG. 4.2
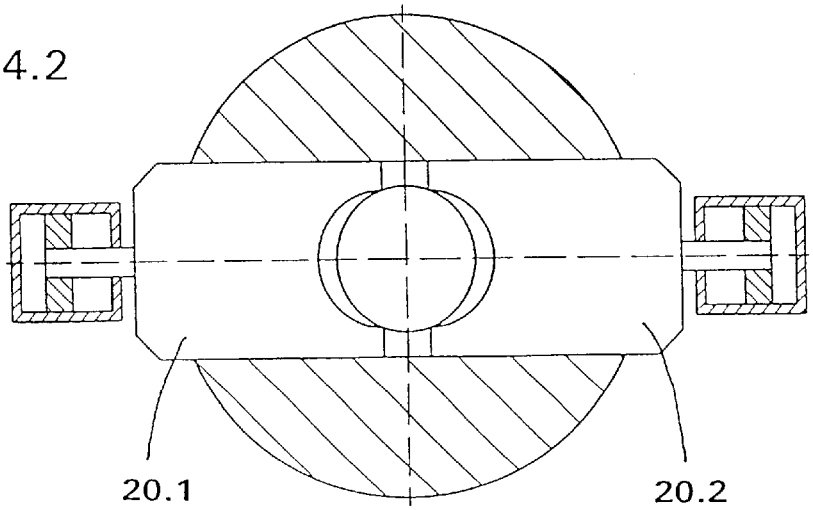

FIG. 5.1
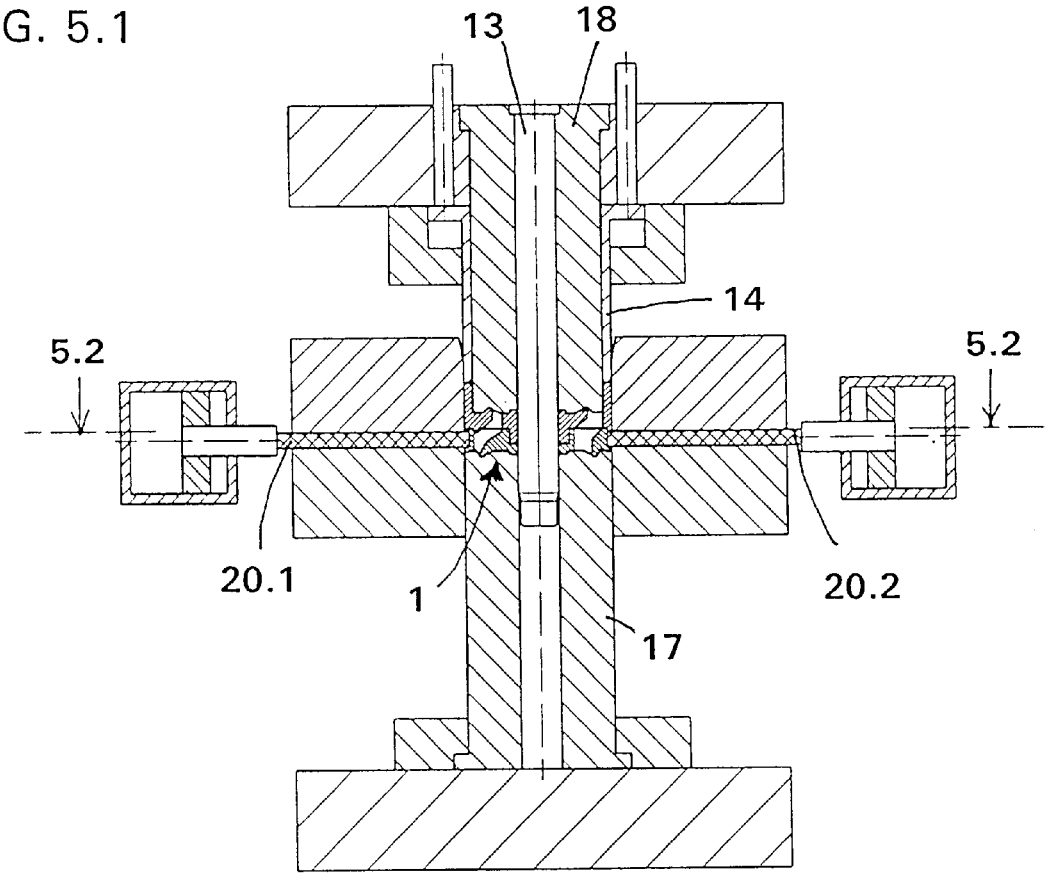
FIG. 5.2
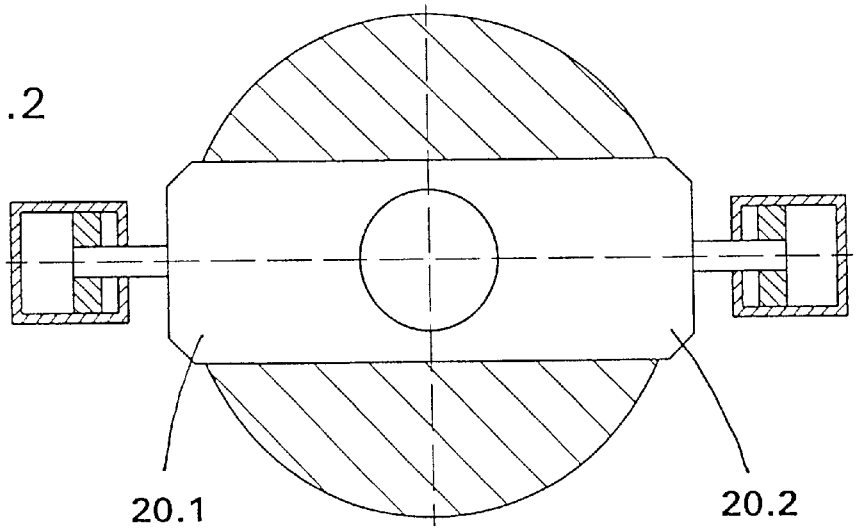

FIG. 6.1
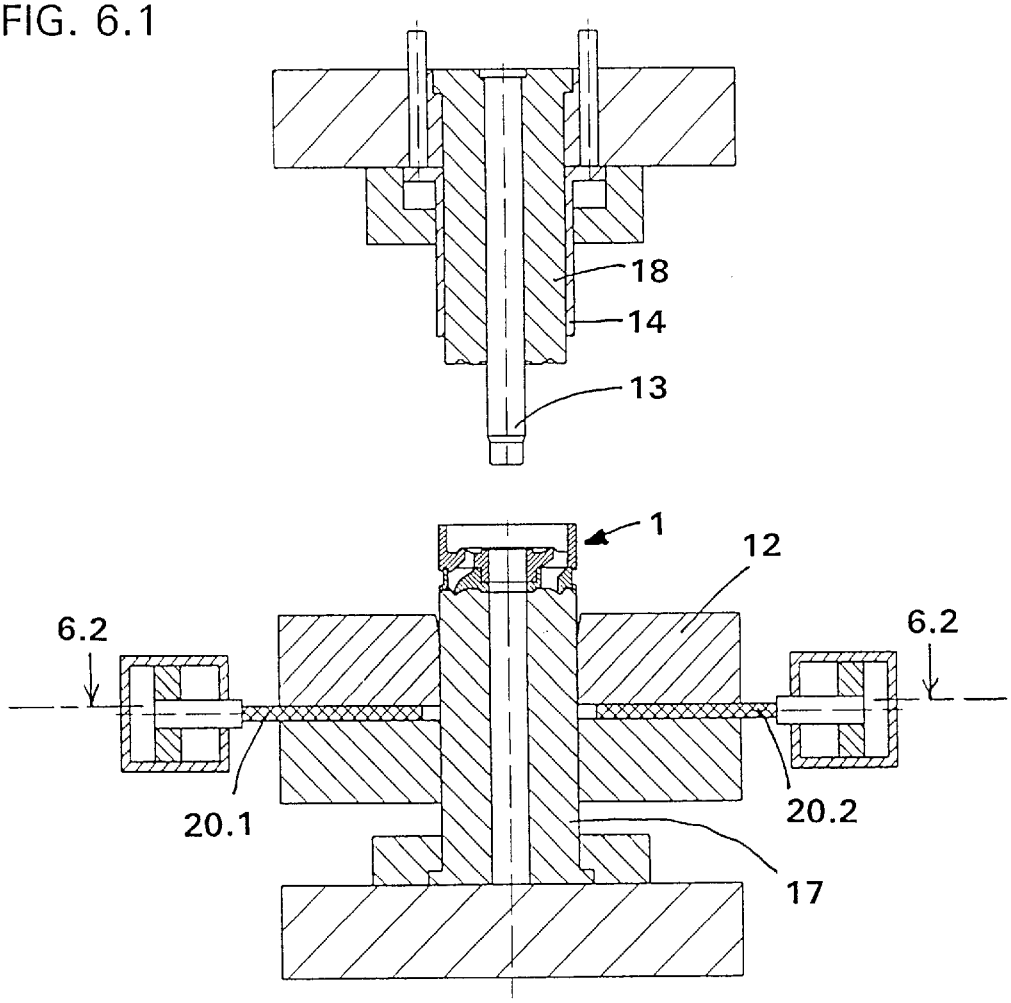
FIG. 6.2
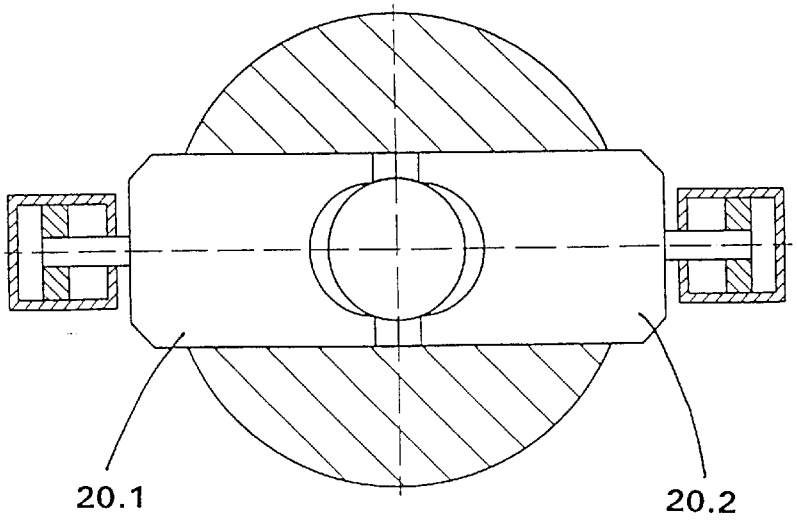

METHOD OF CALIBRATING A PRE-FORMED RECESS

CROSS REFERENCE TO RELATED APPLICATION

This application claims the priority of German Application No. 196 35 183.9 filed Aug. 30, 1996, which is incorporated herein by reference.

BACKGROUND OF THE INVENTION

This invention relates to a method of calibrating a component, such as a sintered body which has two opposite large surfaces and a circumferential (peripheral) surface which connects the large surfaces with one another. In the circumferential surface which may have a continuous and/or polygonal contour, at least one recess is provided by undercutting.

The purpose of a calibrating process with which the invention is concerned is to complete shaped metal components made in large numbers, without expensive chip removal processes or at least by minimizing such steps. Methods used for such a purpose are pressing, pressure casting, fine casting and powder-metallurgical sintering processes performed at ambient or elevated temperatures.

In manufacturing articles by processes in powder metallurgy, powder is pressed by die punches (which may be profiled) into a suitably configured die to assume the desired shape of the component. In some instances mandrels may be used and the process is performed at elevated temperatures, if required. Thereafter the component is sintered. In such manufacturing methods the formation of undercuts at and in the component involves difficulties and therefore often a combination of a powder-metallurgical process with shaping by material removal (chip removal) is resorted to.

Such a process combination is utilized in the manufacture of disk-shaped or cylindrical sintered components, particularly shock absorber pistons. It has been heretofore conventional to provide in the shock absorber piston—formed of a single part, or a plurality of identical or unlike joined parts—a circumferential annular groove by material removal. In case the annular groove is pre-formed during the pressing of a blank parison, after sintering the groove has to be brought to the desired final dimensions by a subsequent material removing process which is time consuming and expensive.

SUMMARY OF THE INVENTION

It is an object of the invention to provide an improved method of manufacturing components of the type outlined above, by means of which the discussed disadvantages are eliminated.

This object and others to become apparent as the specification progresses, are accomplished by the invention, according to which, briefly stated, the method of calibrating a component having first and second opposite large surfaces and a peripheral surface which interconnects the large surfaces and which is provided with a recess, includes the steps of placing the component in a calibrating die, thereafter introducing a calibrating slide into the recess, contacting the first large surface by a first die punch and contacting the second large surface by a second die punch for positively positioning the component in the calibrating die by the calibrating slide and the first and second die punches, and then applying a calibrating pressure to the opposite large surfaces of the component by the die punches for deforming the component to effect calibration of the recess to desired dimensions as determined by a thickness of the calibrating slide situated in the recess.

The method according to the invention as outlined above has the advantage that the method step of making or finishing an article recess by chip removal (material removal) may be eliminated, and thus, as a result, the manufacturing time and costs of sintered components, particularly shock absorber pistons may be lowered.

It has been surprisingly found that it is not necessary to make or finish a recess, for example, an annular groove of a shock absorber piston with shaping by chip removal. Despite the presence of ports (channels) disposed in the shock absorber piston which weaken the form-stability of the shock absorber piston as compared to a solid body, it is possible to calibrate the annular groove without causing such a deformation of the groove or the ports that the shock absorber piston can no longer function.

A partial shaping (deformation) of the annular groove may be achieved by providing that, related to its final dimensions, the annular groove of the shock absorber piston has an undersized diameter and/or an oversized groove width. In this manner a slight clearance remains between the annular groove and the calibrating slide inserted into the groove. By applying a pressure on the die punches, the clearance is closed by a partial deformation of the shock absorber piston and in this manner the annular groove is calibrated to the dimension determined by the calibrating slide. The dimensional accuracy of the groove width and the exact parallelism of the groove flanks to one another are particular advantages obtained with the process when used in the manufacture of shock absorber pistons.

In case the process is practiced in connection with the manufacture of a sintered component provided with an axial recess, according to a further advantageous feature of the invention a calibrating mandrel is introduced into the recess (bore) after positioning the component in a calibrating die. It is an advantage of such a step that the axial recess, such as a bore for receiving the piston rod of a shock absorber piston, is calibrated to its final dimension in the same process step with which the annular piston groove is calibrated. Further, the calibrating mandrel prevents deformations of the axial recess that may be caused by the pressure of the die punch.

In case a component is formed of at least two component parts, according to a particularly advantageous feature of the invention the component parts are joined in a first (preliminary) joining step. Thereafter and before applying the calibrating pressure, a preliminary pressure (joining pressure) is applied to the component to permanently join the component parts to one another. As the next step, the calibrating pressure is applied. This process is advantageous in that the sintered component formed of at least two identical or unlike parts may be inserted in the calibrating die as a unit because of the first (preliminary) joining operation, and in this manner handling (manipulating) problems may be avoided. By applying a preliminary pressure, the parts are permanently joined to one another so that the parts are brought into their final positional relationship to one another and the component is, at its underface, supported on the lower die punch. After the sintered component has been placed into such a positively defined position, the circumferential recess is oriented such that the calibrating slide may penetrate thereinto without damaging the circumferential surface of the sintered component which could otherwise occur in case of an inaccurate positioning of the component in the calibrating die.

According to a further advantageous feature of the invention, at least one component part is fixed in its position by the calibrating slide before applying pressure.

According to another advantageous feature of the invention, the component parts are joined to one another by applying a preliminary pressure to at least one die punch and/or to at least one additional punch parallel to the die punch. The application of a preliminary pressure may be utilized primarily for the final joining of the component parts.

According to a further advantageous feature of the invention, the sintered component is clamped by the die punch and/or the parallel-arranged punch and the pressure required for calibration is applied by at least one of the die punches and/or at least one additional punch oriented parallel to the die punches. By virtue of a multi-part punch it is possible to apply separate, predeterminable pressures at different locations of the sintered component. In this manner the properties of the sintered component such as shape and positional tolerances are being taken into account.

According to another advantageous feature of the invention, the sintered component is clamped by the die punches and/or the parallel additional punch (or additional punches) and the pressure required for calibration is applied by at least one die punch and/or at least one additional punch parallel to the die punch and further, the parallel additional punch presses on the outer edge region of the sintered component. Particularly for calibrating an annular groove of a shock absorber piston it is of advantage to provide that at least one sleeve-like parallel additional punch presses on the edge region of the shock absorber piston, that is, on the region adjoining the annular groove, so that by a predetermined pressure distribution the annular groove is calibrated without causing undesired deformations in the boundary zone between the annular groove and the remainder of the component. Dependent upon the shape of the component, it is feasible to press on the component by the die punch and the parallel punch with identical pressures. It is, however, also feasible to use unlike pressures to achieve an intended local deformation.

BRIEF DESCRIPTION OF THE DRAWINGS

FIGS. 4.1, 5.1 and 6.1 are axial sectional views of a tool for performing the inventive method, showing consecutive operational positions.

FIGS. 4.2, 5.2 and 6.2 are sectional views taken along lines 4.2—4.2, 5.2—5.2 and 6.2—6.2 of FIGS. 4.1, 5.1 and 6.1, respectively.

DESCRIPTION OF THE PREFERRED EMBODIMENTS

Figure 1:
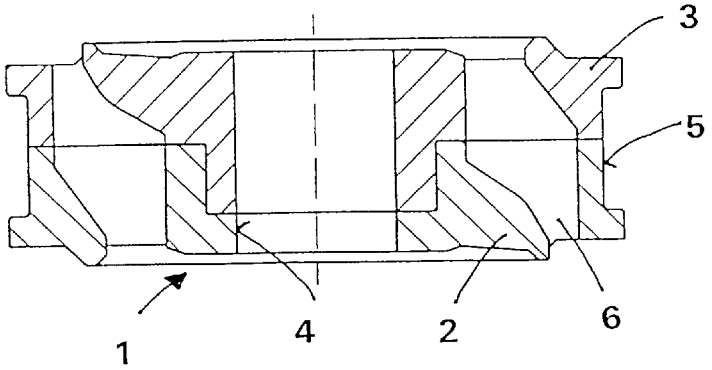
FIG. 1 is an axial sectional view of a two-part shock absorber piston formed of two unlike parts and being adapted to perform the inventive method thereon.

FIG. 1 shows a shock absorber piston 1 which is formed of identical lower and upper piston parts 2 and 3, respectively, and which is axially traversed by a cylindrical bore 4. Further, the shock absorber piston 1 has throughgoing channels 6 which pass through the shock absorber piston 1 substantially in an axial direction. An annular groove 5 provided on the circumferential surface of the shock absorber piston 1 is formed by undercutting the piston parts 2 and 3 and is to be eventually brought to the accurate, desired final dimensions.

Figure 2:
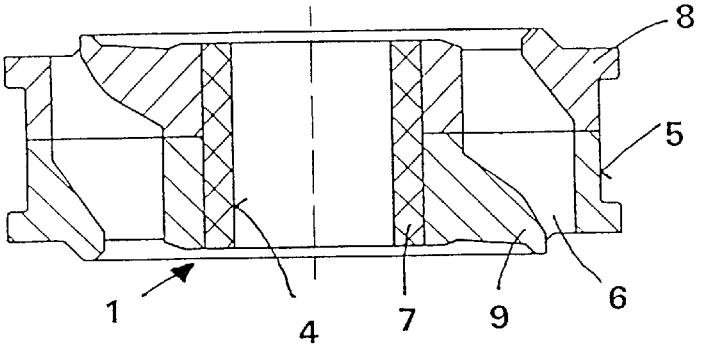
FIG. 2 is an axial sectional view of a three-part shock absorber piston formed of two identical parts and a central sleeve and being adapted to perform the inventive method thereon.

FIG. 2 shows a three-part shock absorber piston 1, composed of a central sleeve 7, as well as identical upper and lower piston parts 8 and 9. The circumferential groove 5 provided on the circumferential surface of the shock absorber piston 1 is formed by undercutting the piston parts 8 and 9; similarly to the groove 5 of the FIG. 1 structure, it has to be brought eventually to the accurate desired dimensions.

Figure 3:
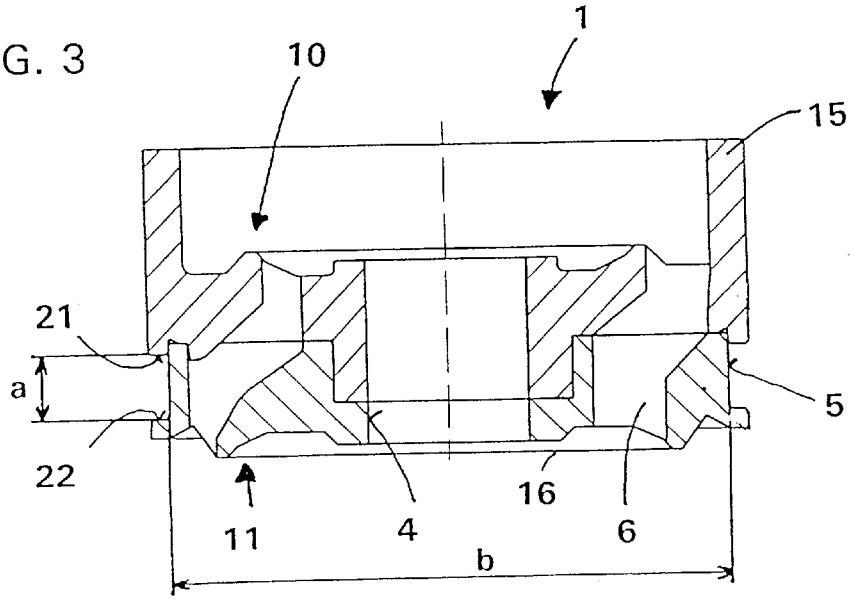
FIG. 3 is an axial sectional view of a two-part shock absorber piston formed of two unlike parts and being adapted to perform the inventive method thereon.

FIG. 3 shows a two-part shock absorber piston 1 based on which an accurate finishing by calibration of the annular groove 5 according to the invention will be explained in conjunction with FIGS. 4.1, 4.2; 5.1, 5.2; and 6.1, 6.2. The shock absorber piston 1 is formed of two unlike piston parts such as the upper piston part 10 and the lower piston part 11. Further, the shock absorber piston 1 has throughgoing passages 6 and on its circumferential face it is provided with an annular groove 5 which is primarily formed on the lower piston part 11 whereas the upper piston part 10 constitutes the lateral boundary of the annular groove 5.

As a first step, the upper and lower piston parts 10 and 11 may be first preliminarily joined together manually or by means of an automatic joining device. The joined shock absorber piston 1 is ready to be inserted into the tool assembly as shown in FIG. 4.1. Thereafter the component 1 is placed into a calibrating die 12 which forms part of the tool assembly and which is bounded by a lower die punch 17. An inner die punch 18 surrounded by an outer, sleeve-like die punch 14 cooperates with the lower die punch 17. The inner and outer die punches form an upper die punch assembly 14, 18.

Subsequently, a calibrating mandrel 13 is introduced into the cylindrical bore 4 of the shock absorber piston 1 and the outer punch 14 is caused to press on the piston skirt 15 of the upper piston part 10. As a result, the shock absorber piston 1 is pushed into the calibrating die 12 until the underside 16 of the shock absorber piston 1 lies on the lower die punch 17. A preliminary pressure exerted by the leading, outer die punch 14 on the upper piston part 10 effects a final joining of the two piston parts 10 and 11. Such a joining, however, may also be effected by the inner punch 18 alone, axially pressing on the upper piston part 10 radially inwardly of the skirt 15 or together with the outer punch 14. The inner die punch 18, the outer die punch 14 and the lower die punch 17 are shaped corresponding to the outer surfaces of the upper and lower piston parts 10 and 11, respectively.

After the joined shock absorber piston 1 lies on the lower die punch 17 in the die 12 and is clamped therein by and the upper die punch assembly 14, 18, the calibrating slides 20.1 and 20.2 are moved radially into the annular groove 5 of the shock absorber piston 1 and the joining of the two parts of the shock absorber piston 1 is effected at a preliminary pressure of approximately 25 MPa. This operational position is depicted in FIG. 5.1. The outer dimensions of the calibrating slides 20.1, 20.2 extending into the annular groove 5 correspond to the desired final dimensions of the annular groove 5.

Thereafter, the upper die punch assembly 14, 18 applies a calibrating pressure of approximately 200–400 MPa to the shock absorber piston 1. During this process step the excess axial (height) calibrating dimension assigned to the component is reduced from 1 to 10% by a plastic deformation so that, in particular, the annular groove 5 obtains the desired final dimensions. While the outer punch 14 is required primarily for obtaining the desired calibration for the groove, the inner punch 18 provides primarily for all other dimensions. It is of particular significance that upon conclusion of the calibrating process the width (that is, the axial dimension) and the diameter of the annular groove are calibrated to the respective dimensions a and b (FIG. 3), and the upper and lower groove flanks 21 and 22 are parallel to one another.

In case of sintered and joined shock absorber pistons 1, prior to the calibrating process the groove width is slightly greater and the groove diameter is slightly smaller than the desired final dimensions. By pressing with the die punches 14, 18 and 17 on the shock absorber piston 1 while the calibrating slides 20.1, 20.2 are situated in the annular groove 5, by means of partial deformations the groove width a and the groove diameter b are brought to the final desired dimension and the parallelism of the annular groove flanks 21 and 22 is ensured. It is feasible to charge both the inner die punch 18 and the outer die punch 14 with approximately the same pressure or to calibrate by means of different pressures. Particularly, it is feasible to calibrate the annular groove by applying a higher pressure on the outer die punch 14.

FIG. 6.1 shows the removal of the shock absorber piston 1 from the calibrating tool. For this purpose the calibrating slides 20.1 and 20.2 are moved radially out of the calibrated annular groove 5 and the shock absorber piston 1 is ejected from the calibrating die 12 by the lower punch 17.

The cross-sectional illustrations in FIGS. 4.2, 5.2 and 6.2 show particularly the position of the calibrating slides 20.1 and 20.2 in the operational phase depicted in respective FIGS. 4.1, 5.1 and 6.1.

It will be understood that the above description of the present invention is susceptible to various modifications, changes and adaptations, and the same are intended to be comprehended within the meaning and range of equivalents of the appended claims.

What is claimed is:

1. A method of making and calibrating a piston, comprising the steps of:

providing a first piston part having a first end face;

providing a second piston part having a second end face;

providing a calibrating die having a first die punch and a second die punch;

providing a calibrating slide having a thickness;

preliminarily joining said first piston part to said second piston part, thereby providing a preliminarily joined component having an outer peripheral surface defining a circumferential groove therein that has an initial width greater than the thickness of the calibrating slide; then placing said preliminarily joined component into said calibrating die such that said first end face rests on said first die punch; then introducing said calibrating slide into said circumferential groove; then moving said first die punch and second die punch relatively towards each other, thereby causing said second die punch to contact and force said second end face towards said first end face, whereby (I) said first piston becomes finally joined to said second piston part, and then (II) at least one said first and second piston parts becomes deformed, whereby said circumferential groove attains a final width that is substantially equal to the thickness of the calibrating slide.

2. The method according to claim 1, wherein said first piston part and said second piston part each have a bore extending therethrough, and further comprising the step of introducing a calibrating mandrel through said bores after the placing step and before the moving step, thereby centering said preliminarily joined component within said calibrating die.

3. The method according to claim 1, wherein said second die punch includes an inner portion and an outer portion surrounding the inner portion and being movable relative to said inner portion, wherein during the moving step:

(I) said inner portion contacts and forces said second end face towards said first end face, whereby said first piston part becomes finally joined to said second piston part, and (II) said outer portion contacts and deforms at least one of said first and second piston parts, whereby said circumferential groove attains the final width that is substantially equal to the thickness of the calibrating slide.

4. The method according to claim 1, and further comprising the step of contacting said second end face with said second die punch while said first end face rests on said first die punch and prior to performing the introducing step, thereby clamping said preliminarily joined component between said first die punch and said second die punch.

* * * * *